US006132071A

United States Patent [19]

Yuen

[11] Patent Number: 6,132,071

[45] Date of Patent: Oct. 17, 2000

[54] COMBINED INCANDESCENT/ FLUORESCENT LANTERN

[75] Inventor: John Se Kit Yuen, Kowloon, The Hong Kong Special Administrative Region of the People's Republic of China

[73] Assignee: John Manufacturing Limited, Kowloon, The Hong Kong Special Administrative Region of the People's Republic of China

[21] Appl. No.: 09/247,808

[22] Filed: Feb. 11, 1999

[30] Foreign Application Priority Data

Sep. 3, 1998 [GB] United Kingdom ..... 9819247

[51] Int. Cl.[7] ..... F21W 111/10; F21V 14/02

[52] U.S. Cl. ..... 362/427; 362/260; 362/225; 362/220; 362/287; 362/184; 362/197; 362/199; 362/250

[58] Field of Search ..... 362/260, 225, 362/223, 220, 285, 287, 184, 190, 191, 196, 197, 199, 427, 250

[56] References Cited

U.S. PATENT DOCUMENTS

| | | | |
|---|---|---|---|
| 4,977,489 | 12/1990 | Fung | 362/184 |
| 5,217,297 | 6/1993 | Yuen | 362/184 |
| 5,530,633 | 6/1996 | Yuen | 362/184 |
| 5,548,494 | 8/1996 | Blackman | 362/184 X |
| 5,570,948 | 11/1996 | Menke et al. | 362/191 |
| 5,595,441 | 1/1997 | McGee | 362/191 X |
| 5,915,825 | 6/1999 | Weister | 362/191 X |

FOREIGN PATENT DOCUMENTS

| | | |
|---|---|---|
| 2 071 491 | 9/1981 | United Kingdom . |
| 2 248 292 | 4/1992 | United Kingdom . |

*Primary Examiner*—Laura K. Tso
*Attorney, Agent, or Firm*—Mattingly, Stanger & Malur

[57] ABSTRACT

A combined incandescent/fluorescent lantern comprising a main portion containing an incandescent bulb and at least two lighting arms which pivot with respect to the main portion about respective spaced apart axes; each lighting arm having a fluorescent tube and being moveable with respect to the main portion with an arc to position the fluorescent tubes for the illumination required.

5 Claims, 4 Drawing Sheets

COMBINED INCANDESCENT/ FLUORESCENT LANTERN

BACKGROUND OF THE INVENTION

This invention relates to combined incandescent/ fluorescent lanterns.

Lanterns have previously been proposed which include both an incandescent bulb surrounded by a reflector to provide a directable beam of light and also a fluorescent tube which when energised provides more general diffused illumination.

These lanterns have comprised a generally rectangular elongate housing with the incandescent bulb and reflector provided to direct an axial beam from one with a side face of the housing having the fluorescent tube therein. A disadvantage of this design is that the lantern must itself be rotated to direct the fluorescent beam as required.

One previously proposed solution, disclosed in GB-A-2 248 292, is for the fluorescent tube lighting arm which runs parallel to an elongate handle portion. The incandescent bulb is mounted at one end of the handle portion which is joined to the lighting arm by a pivot joint with an axis transverse to the longitudinal extent of the handle portion. The lighting arm may be rotated to any position within an arc of 180° to position the tube as desired. The end of the handle portion containing the incandescent bulb is used to provide a stable base.

The above lanterns only contain a single fluorescent tube. In order to provide a wider beam of light a fluorescent lantern with two fluorescent tubes has been proposed (Registered Design No: 2071491), substantially similar to the rotating fluorescent lantern detailed above in that both fluorescent arms rotate around a single pivot. In this way the lantern may be used to illuminate an area of substantially larger diameter than with one fluorescent tube alone, or with two non-rotatable single tubes.

This design suffers from a serious disadvantage, however. The freedom of movement of the lighting arms is constrained so that they cannot be rotated apart through an arc of substantially more than 240°. This limits the flexibility of the lantern. Furthermore each arm is difficult to move independently.

SUMMARY OF THE INVENTION

The invention provides a combined fluorescent/ incandescent light comprising a main portion containing an incandescent bulb; and at least two lighting arms which pivot with respect to the main portion about respective spaced apart axes; each lighting arm having a fluorescent tube and being moveable with respect to the main portion through within an arc of at least substantially 180° to position the fluorescent tubes for the illumination required.

Both of the problems described above are due to the lighting arms being rotated around a single pivot point. The width of the pivoting mechanism constrains the rotation of the lighting arms and due to friction at this single pivot joint one arm tends to move when the other is rotated. The invention as described above thus enables free and independent movement of each arm to any point in an arc of substantially at least 180°.

Furthermore if each lighting arm on the lantern has an axis of rotation substantially transverse to the longitudinal axis of the main portion the amount of rotation possible for each arm will generally be substantially greater than that for more oblique pivot axes, and the width of beam that may be achieved by separating the two arms will generally be substantially greater. Furthermore the ease of manufacturing the lantern will be increased.

If the lantern has its pivot joint positioned at or near the end of the lighting arm, the movement of the lighting arm away from the main body of the lantern will be increased, giving greater flexibility to the lantern.

Preferably the main body of the lantern will contain a compartment to place the source of electric power for the lights.

BRIEF DESCRIPTION OF THE DRAWINGS

Embodiments of the invention will now be described with reference to the accompanying drawings, throughout which parts are referred to by like references and in which.

DETAILED DESCRIPTION OF THE INVENTION

Figure 1:
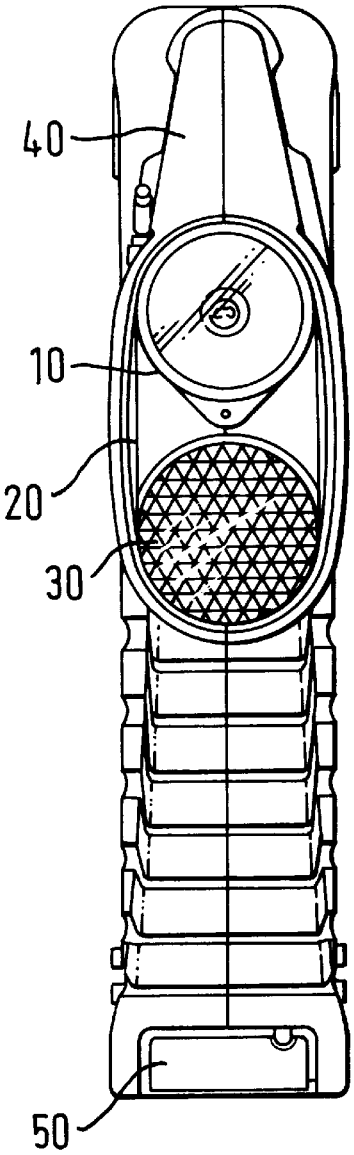
FIG. 1 is a schematic front view of a combined incandescent/fluorescent lantern with the lantern standing on its base.

FIG. 1 illustrates the front end of the lantern, showing an incandescent spotlight bulb and reflector 10 which provides the means for directing forward a generally parallel circular beam of light. Next to this bulb is coloured lens 30 which is able to slide along front recess 20. The moulded plastic handle 40 provides a means to conveniently carry the lantern.

Figure 2:
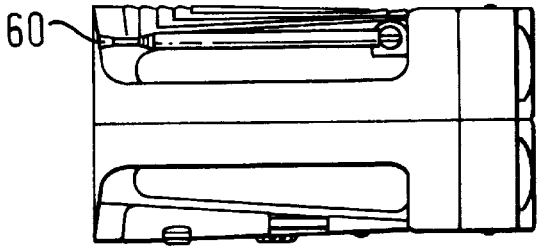
FIG. 2 is a schematic top view of the lantern.

In this embodiment the lantern combines its lighting functions with a radio. In FIG. 2, a radio antenna 60 may be seen clipped into the top of the case beneath the handle 40.

Figure 3:
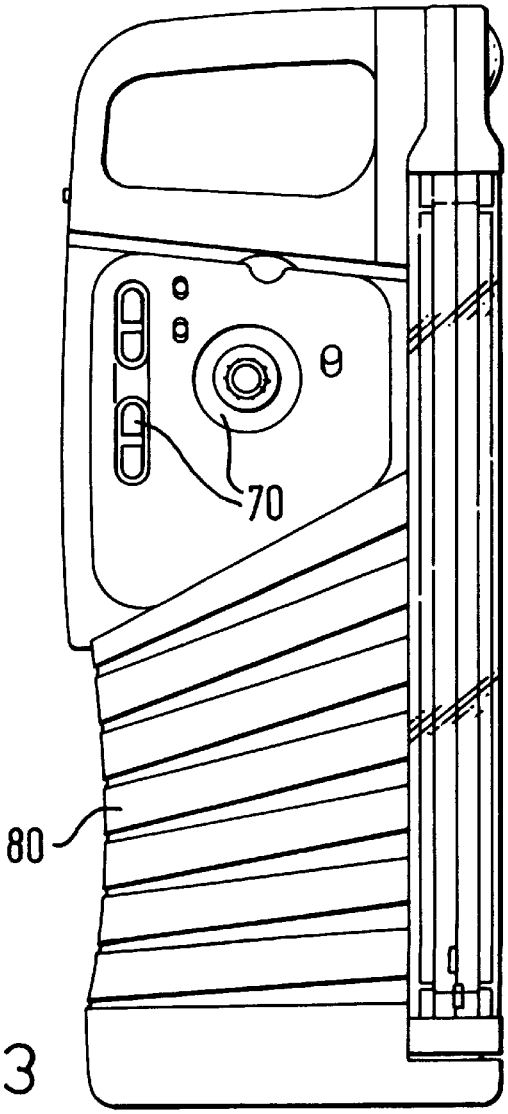
FIG. 3 is a schematic side view of the lantern.

FIG. 3 shows controls 70 for the lighting and radio functions. Decorative mouldings 80 are illustrated down the side of the lantern casing. These also provide an easy way to grip the lantern if it must be held up.

Figure 4:
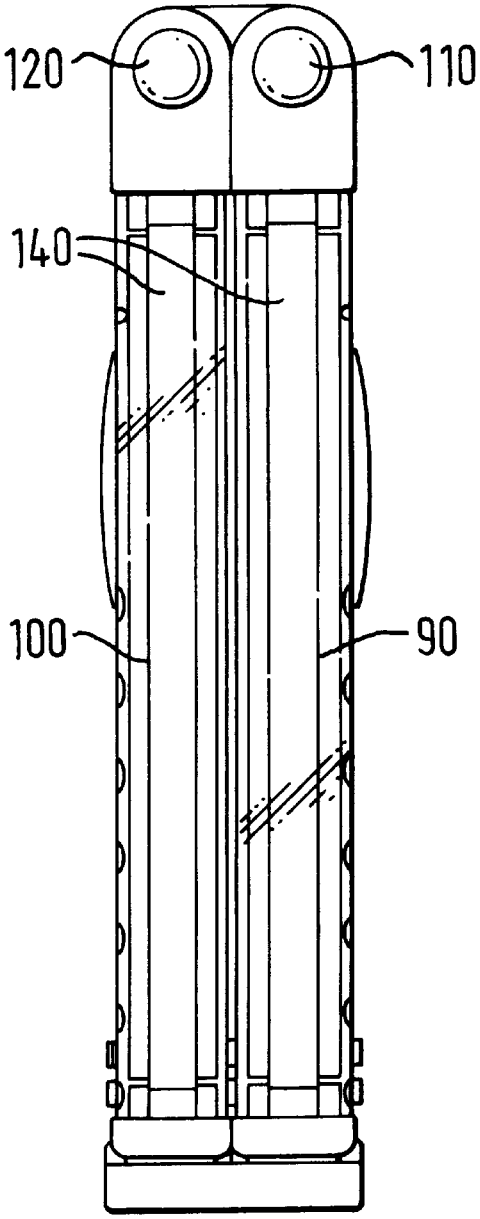
FIG. 4 is a schematic back view of the lantern.

In FIG. 4 two lighting arms 90 and 100 are seen in the closed position. Each contains a fluorescent tube 140. The arms are coupled to the main portion of the lantern at pivot joints 110 and 120 with respective spaced apart pivot axes transverse to the elongate main portion of the lantern. The bottom part of these lighting arms, as seen in FIG. 4, is not connected to the main part of the lantern so that the tubes may independently rotate through an arc of 180° from the closed position to a fully extended position 8*f* through a plurality of intermediate positions 8*a* to 8*e*. In each of the closed and fully extended positions, the lighting arms 90, 100 substantially abut one another as shown. Additionally in this embodiment, both arms may be rotated clockwise or both anti-clockwise to a position around 8*a*. Which of the positions is selected depends on the particular illumination required from the fluorescent tube.

Figure 5:
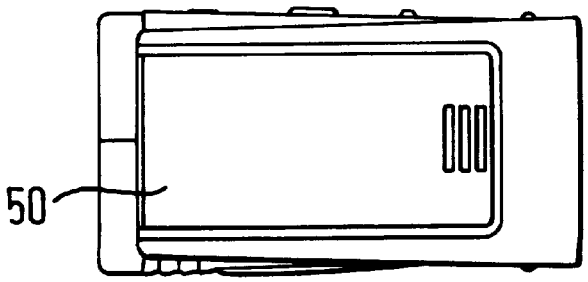
FIG. 5 is a schematic showing the underneath of the lantern.

FIG. 5 shows a battery compartment 50 positioned in the base of the lantern.

Figure 6:
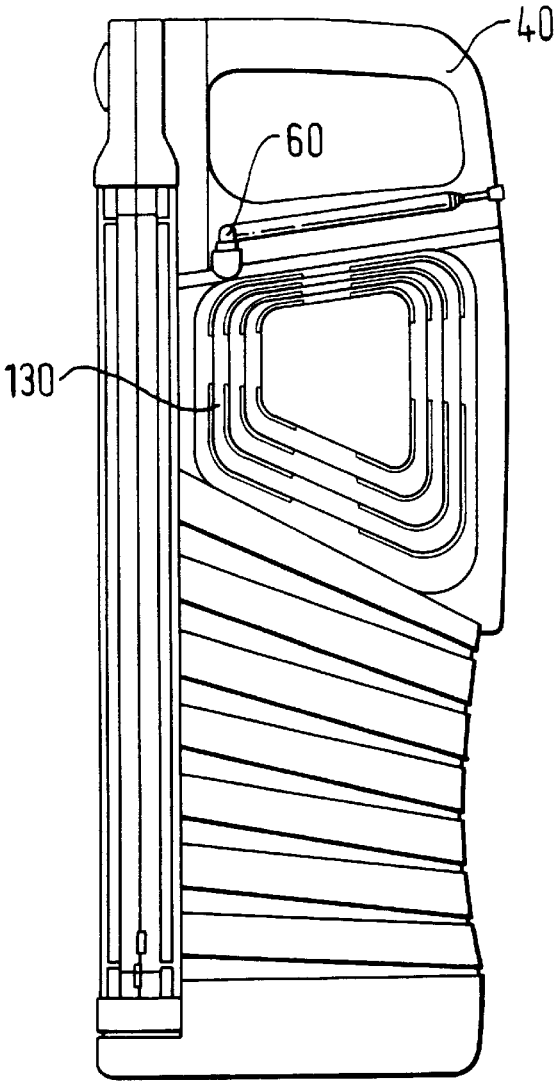
FIG. 6 is a schematic showing the opposite side view to FIG. 3.

In FIG. 6 the opposite side view of the lantern is shown. In this view further decorative mouldings 130 correspond to the position of the controls 70 on the opposite side. The stored position of the radio antenna 60 which abuts the base of the handle 40 is clearly shown.

Figure 7:
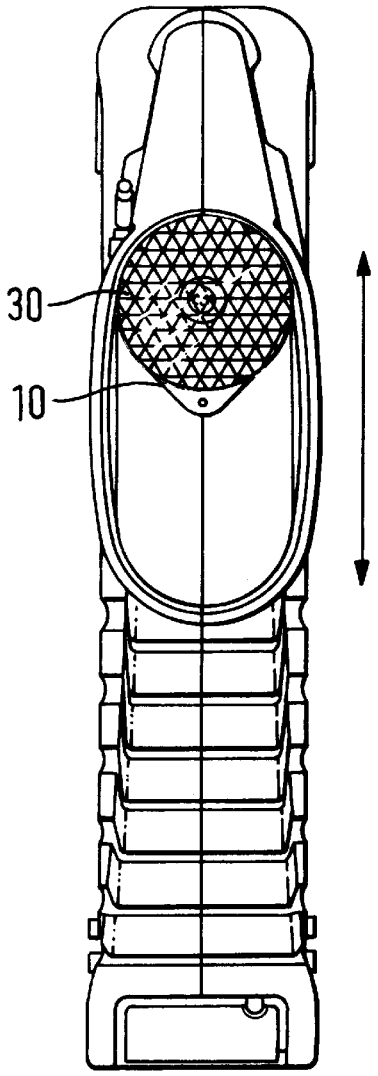
FIG. 7 is a schematic view showing the slideable coloured lens of the lantern moved to cover the incandescent bulb.
Figure 8:
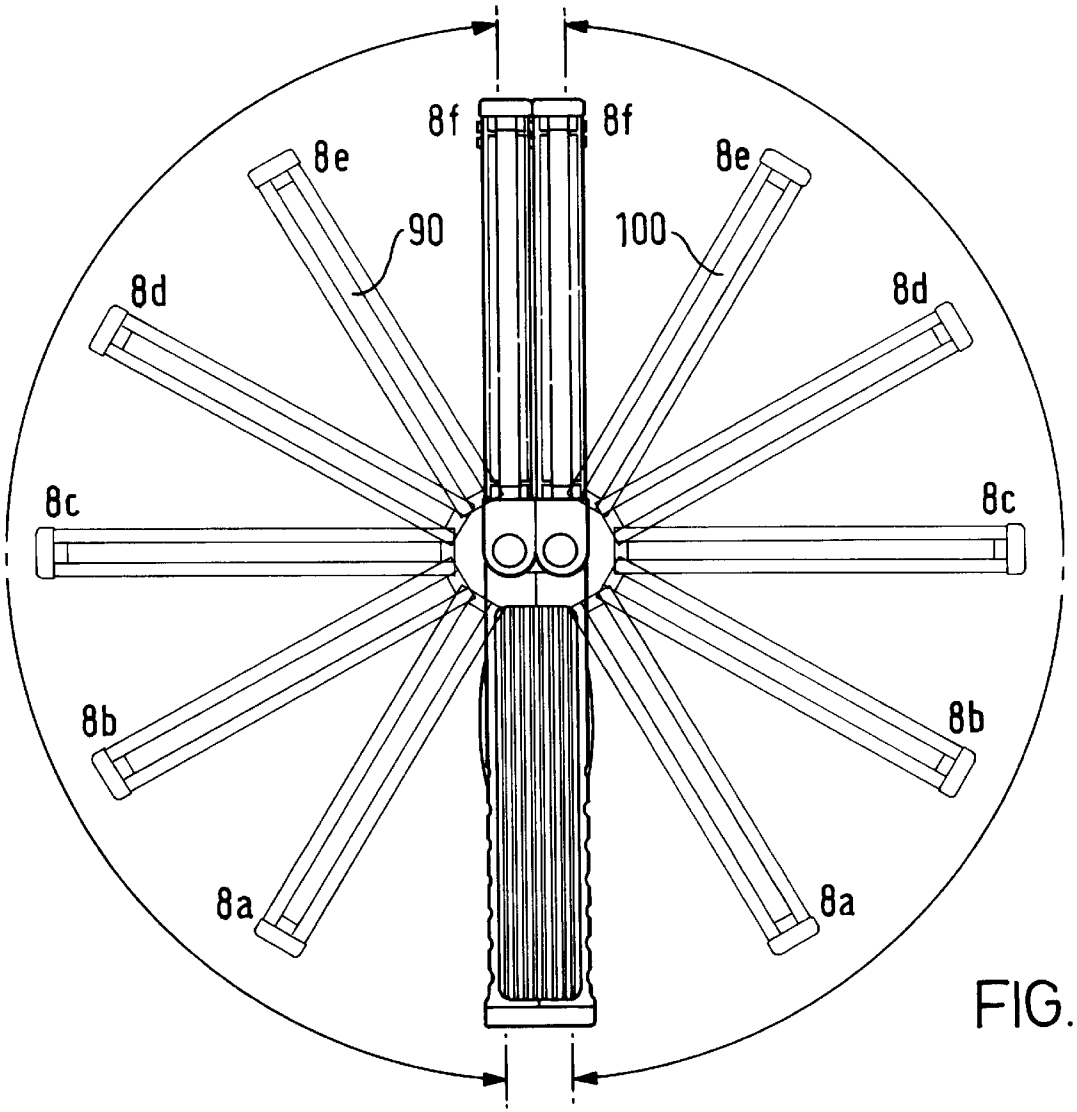
FIG. 8 shows schematically another side view illustrating the range of rotation of the twin fluorescent lights.

FIG. 7 illustrates the sliding mechanism of the coloured lens 30. This may be slid over the incandescent spotlight 10 in order to provide a warning or distress signal.

What is claimed is:

1. A combined incandescent/fluorescent lantern, comprising:

main portion;

an incandescent bulb contained in the main portion;

two lighting arms;

a respective fluorescent tube contained in each lighting arm;

a respective pivot joint for each lighting arm;

a respective axis for each pivot joint;

said axes being spaced apart so that said lighting arms are pivotable with respect to the main portion through an arc of substantially 180° between a closed position and a fully extended position through a plurality of intermediate positions, wherein said lighting arms substantially abut one another in each of said closed and fully extended positions.

2. A lantern as claimed in claim 1, wherein the respective pivot axis of each lighting arm extends substantially transverse to a longitudinal axis of the main portion.

3. A lantern as claimed in claim 1, where each pivot joint is positioned at one end of the respective lighting arm.

4. A lantern as claimed in claim 1, wherein the main portion provides a compartment for housing at least one electric cell.

5. A lantern as claimed in claim 1, where each pivot joint is positioned near one end of the respective lighting arm.

* * * * *